US006517273B2

(12) United States Patent
Koyama et al.

(10) Patent No.: US 6,517,273 B2
(45) Date of Patent: Feb. 11, 2003

(54) FREE-INK TYPE WRITING INSTRUMENT

(75) Inventors: Takao Koyama, Ashikaga (JP); Kazuhisa Kirita, Sawa-gun (JP); Atsushi Iwasa, Kodama-gun (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/011,438

(22) Filed: Dec. 11, 2001

(65) Prior Publication Data

US 2002/0081142 A1 Jun. 27, 2002

(30) Foreign Application Priority Data

Dec. 26, 2000 (JP) ..... 2000-395807

(51) Int. Cl.[7] ..... B43K 5/18

(52) U.S. Cl. ..... 401/198; 401/223; 401/225; 401/227; 401/229

(58) Field of Search ..... 401/198, 233, 401/224, 225, 227, 228, 229, 230, 241

(56) References Cited

U.S. PATENT DOCUMENTS

| | | | | | |
|---|---|---|---|---|---|
| 3,951,555 | A | * | 4/1976 | Wittnebert et al. | 401/199 X |
| 4,954,002 | A | * | 9/1990 | Wallis et al. | 401/224 X |
| 2001/0004430 | A1 | * | 6/2001 | Mito et al. | 401/223 |
| 2001/0016142 | A1 | * | 8/2001 | Koyama | 401/222 |

FOREIGN PATENT DOCUMENTS

| | | | | |
|---|---|---|---|---|
| EP | 1095791 | * | 11/1999 | 401/223 |
| WO | 94/08798 | * | 4/1994 | 401/225 |

* cited by examiner

*Primary Examiner*—David J. Walczak
*Assistant Examiner*—Kathleen J. Prunner
(74) *Attorney, Agent, or Firm*—Burns, Doane, Swecker & Mathis LLP

(57) ABSTRACT

A free-ink type writing instrument having a temporary ink collector having a sectionally combed configuration, between an ink tank chamber and an writing tip and inside the front barrel, wherein all or part of the gaps between neighboring combed teeth for retaining ink in the temporary ink collector are set equal to 0.15 mm or smaller, and the ink tank is charged with an ink having a surface tension equal to 30 mN/m or lower at 25° C.

1 Claim, 2 Drawing Sheets

FREE-INK TYPE WRITING INSTRUMENT

BACKGROUND OF THE INVENTION (1) Field of the Invention

The present invention relates to a free-ink type writing instrument having an ink collector which temporarily stores ink flowing out when the pressure inside the ink tank increases.

(2) Description of the Prior Art

There have been known free-ink type writing instruments which use a temporary ink collector arranged radially outside, and separated from, its ink feed connected to the ink tank and made up of a molding having a comb-toothed section or an temporary ink collector made up of a porous structure and filled up with a water-based ink having a surface tension of greater than 30 mN/m under 25° C. ambient temperature, whereby ink from the ink tank is temporarily held in the ink collector when the internal pressure of the ink tank space increases so as to prevent ink ejection from the writing point. In these writing instruments, the combed teeth are arranged with their gaps equal to or greater than 0.2 mm.

When, however, a line is drawn on the writing surface having a low surface energy such as polypropylene or polyethylene sheet, paper with sebum adhering thereon, glass surface, or the like using a water-based ink having a surface tension of greater than 30 mN/m, there is a problem of drawn lines being repellent (ink of drawn lines being unable to stay on the writing surface).

In order to solve this problem, ink should preferably have a surface tension of 30 mN/m or below and more preferably have a surface tension of 27 mN/m or below. Such ink of a low-surface tension is often used for oil-based makers and water-based makers having beneficial adhesiveness, but such writing instruments are not of free-ink type including a sectionally comb-shaped temporary ink collector.

Further, when an ink having a surface tension of 30 mN/m or below is charged to a free-ink type writing instrument having the aforementioned combed teeth gaps of 0.2 mm or greater, because of its low surface tension hence insufficiency of the capillarity of the gaps, most of ink having flown into and between combed teeth cannot stay therein but will leak out from the writing tip when the pen is put with its writing point downward. On the other hand, liquids of a large surface tension generally present a low vapor pressure so are poor in their drying property.

SUMMARY OF THE INVENTION

It is therefore an object of the present invention to provide a free-ink type writing instrument which is able to use an ink having a surface tension of 30 mN/m or lower so that lines of the ink can be drawn without being repellent on a writing surface of a low surface energy and the ink is excellent in drawn line drying property, and still can retain the whole ink that has been pushed out by volume expansion of the empty space inside the ink tank due to ambient changes, within a temporary ink collector without forward leakage of ink from the writing tip.

In order to achieve the above object, the present invention is configured as follows:

A free-ink type writing instrument according to the present invention includes: an ink tank chamber; a writing tip; a temporary ink collector having a sectionally combed configuration, disposed between the ink tank chamber and the writing tip; a partitioning wall having an air replacement hole therein, disposed for separating the ink tank chamber and the temporary ink collector; and an ink feed or pen core arranged so as to penetrate through the temporary ink collector and projected into, or penetrated up to, the ink tank chamber, and is characterized in that the sectionally comb-shaped temporary ink collector is disposed 2.0 cm or greater away from the writing point, all or part of the gaps between neighboring combed teeth for retaining ink in the temporary ink collector are set equal to 0.15 mm or smaller, and the ink tank is charged with an ink having a surface tension equal to 30 mN/m or lower at 25° C.

In the present invention, not all the gaps between neighboring combed teeth should be necessarily set equal to or smaller than 0.15 mm(preferably 0.13 mm), but it is more preferred that at least part or all of the combed gaps located 2.0 cm or greater away from the writing point should be set equal to or smaller than 0.15 mm(preferably 0.13 mm). Also in the portion near the writing tip or located less than 2.0 cm away from the writing point, it is preferred that the combed gaps are set equal to 0.15 mm or smaller (preferably 0.13 mm), in view of securing a greater capillarity. However, since the stored amount of ink per tooth becomes low, such setting is inefficient in view of material consumption. Therefore, the combed gaps located less than 2.0 cm away from the writing point should be determined as appropriate considering the ink's surface tension., economical efficiency, global environment concerns and the like.

Concerning the organic solvents used as the solvent for ink, any organic solvent can be used as long it is generally used for writing instruments. For example, monohydric alcohols such as ethanol, n-propanol, etc., polyhydric alcohols such as propylene glycol mono-methyl-ether, etc., can be considered.

Any material can be used for the ink tank chamber and the sectionally comb-shaped temporary ink collector as long as it does not cause swelling, whitening, dissolution, embrittlement and other defects when it is put into contact with ink. When considering moldability, economical efficiency, global environment concerns such as recylability, a resin selected from a group made up of polyester resin, polypropylene resin, polyethylene resin, polyamide resin is preferably employed as the material for the ink tank chamber when an organic polar solvent is used as the main solvent of the ink; a resin selected from a group made up of polyethylene resin, polyamide resin is preferably employed when an organic non-polar solvent is used as the main solvent. When water is used as the main solvent, a resin selected from a group made up of acrylic resin, styrene resin, vinyl polymer, vinylidene polymer, polycarbonate resin, polyester resin, polyolefine resin such as polypropylene, polyethylene, polyarylate resin is preferably used. As the material for the sectionally comb-shaped temporary ink collector, a resin selected from a group made up of polyester resin and polyolefine resin such as polypropylene, polyethylene is preferably used when the organic solvent is of a polar solvent; a resin selected from a group made up of polyethylene resin and polyamide resin is preferably used when the organic solvent is of a non-polar solvent; and acrylic resin, polystyrene resin, vinyl polymer, vinylidene polymer, polycarbonate resin, polyester resin, polyolefine resin such as polypropylene and polyethylene, polyarylate resin, ABS resin, polyacetal resin and others can be preferably used when the ink is based on water as the main solvent.

DESCRIPTION OF THE PREFERRED EMBODIMENTS

The embodiment of the present invention will hereinafter be described in detail including examples with reference to the accompanying drawings.

Figure 1:
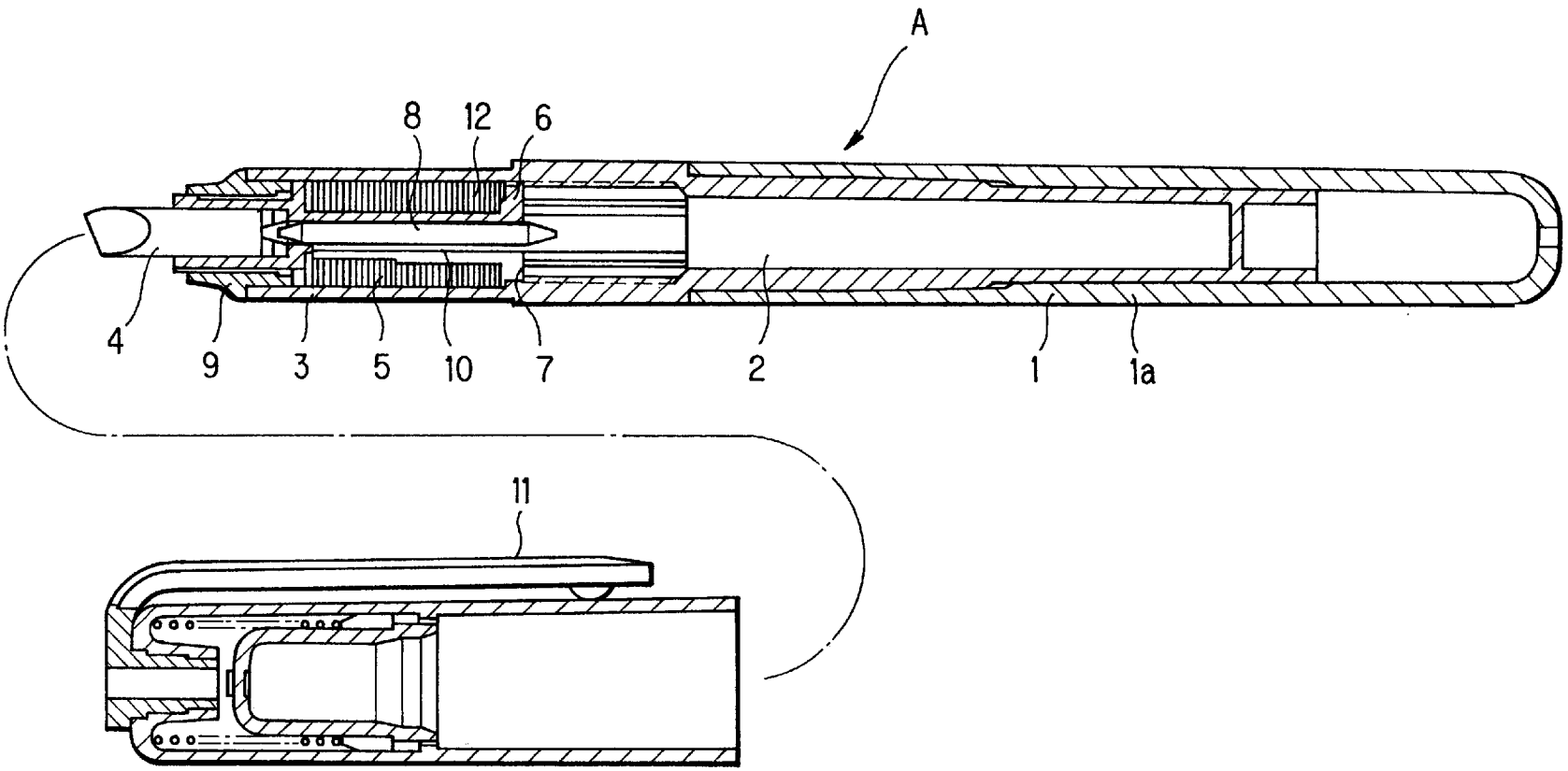
FIG. 1 is an overall vertical section of a free-ink type writing instrument having a sectionally comb-shaped temporary ink collector.

In the embodiment, a writing instrument A shown in FIG. 1 is a free-ink type writing instrument which has a temporary ink collector 5 having a combed section inside a front barrel 3 between an ink tank chamber 2 inside a rear barrel 1 and a writing point 4*a* of a pen core 4 attached at the front end of front barrel 3. A partitioning wall 6 is disposed between the temporary ink collector 5 and ink tank chamber 2 with an air replacement hole 7 formed therein. Further, an ink feed (or pen core if it also serves as an ink feed) 8 is projected or penetrated into the interior of ink tank chamber 2.

The sectionally comb-shaped temporary ink collector 5 is a molding made of polypropylene and is arranged between ink tank chamber 2 made of polypropylene and writing point 4*a* made up of a polyester fiber bundle or fluted bar element. Pen core 4 is fixed at the front end of front barrel 3 by a plastic mouth (fitting element) 9, and the front end of ink feed 8 is fitted into the rear end of pen core 4. The temporary ink collector has an ink feed channel (slit or vertical groove) 10 formed continuously from air replacement hole 7. Rear barrel 1 is constituted by an outer barrel la, which is provided separately from the ink tank. A cap element 11 for protection against ink drying is provided to cover writing point 4a of front barrel 3.

Figure 2:
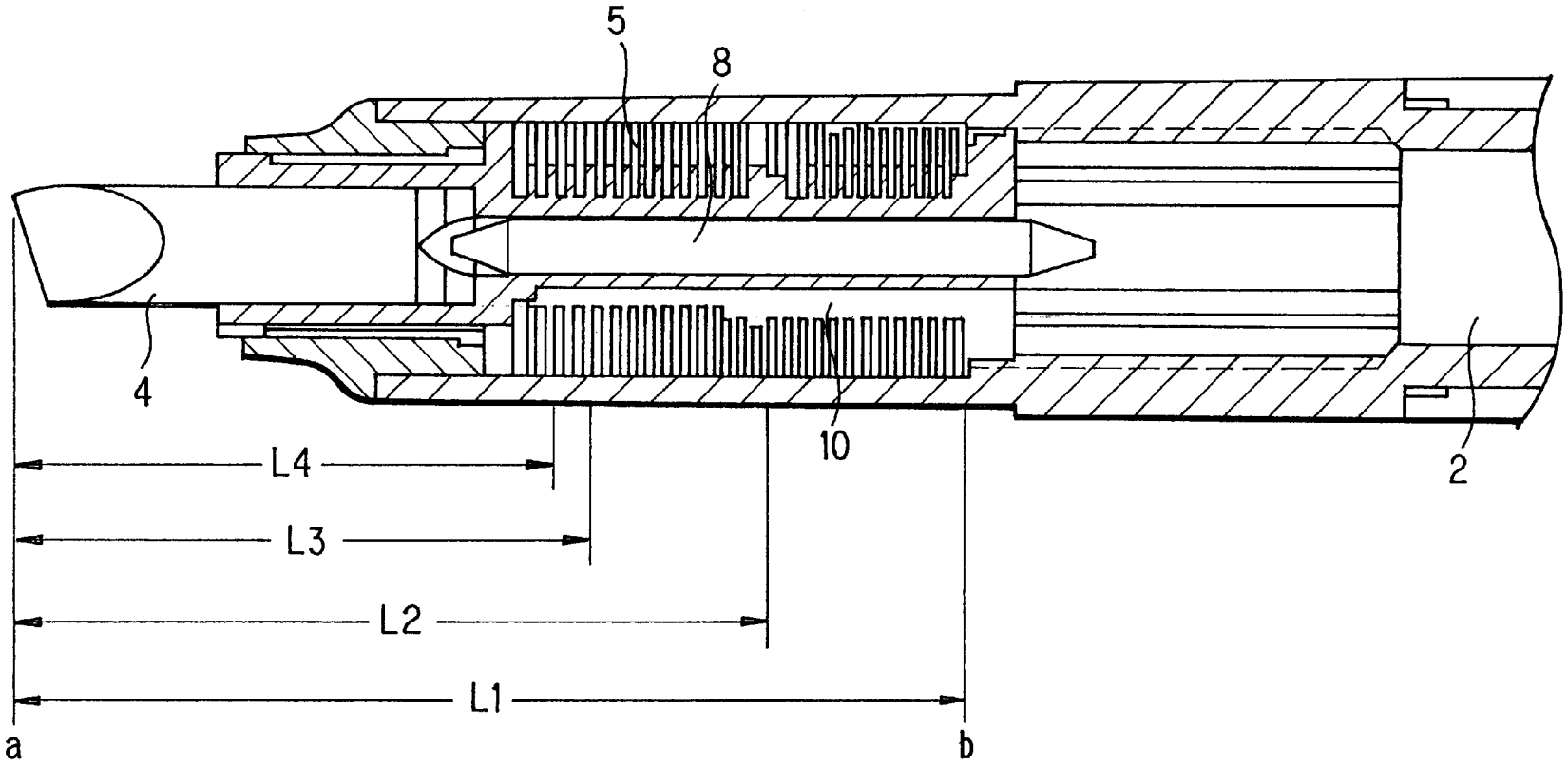
FIG. 2 is a partial vertical sectional view showing the writing instrument of FIG. 1.

FIG. 2 shows a detailed sectional view of sectionally comb-shaped temporary ink collector 5 used in the embodiment. This temporary ink collector 5 is configured so that when the pressure inside ink tank chamber 2 has changed due to change in usage environment, the ink therein can be introduced from the aforementioned air replacement hole 7 via ink feed channel 10 into a large number of gaps 12 formed between the combed teeth and stored therein.

In this writing instrument, an ink having a surface tension of 30 mN/m or lower at 25° C. is charged while all or part of the gaps 12 between the combed teeth for retaining ink, in sectionally comb-shaped temporary ink collector 5, are formed to be 0.15 mm or smaller in width.

Example 1

Example 1 of the present invention will be described.

This sectionally comb-shaped temporary ink collector was constructed such that the farthest comb-toothed gap from the point 'a' of writing tip 4 was positioned at 'b', L1=3.5 cm away from the writing point, all the comb-toothed gaps located away by L2=2.7 cm or greater from the writing point were set at 0.15 mm, all the comb-toothed gaps located away by L2 to L3 (2.2 cm to shorter than 2.7 cm) from the writing point are set at 0.20 mm, and all the comb-toothed gaps located shorter than L3=2.2 cm away from the writing point were set at 0.25 mm.

As shown in FIG. 1, temporary ink collector 5 and ink tank chamber 2 were separated by partitioning wall 6 having air replacement hole 7 of a channel narrower than all the comb-toothed gaps in the sectionally comb-shaped temporary ink collector while the pen core was arranged so as to penetrate through temporary ink collector 5 into the ink tank chamber. The ink tank of the thus constructed free-ink type writing instrument was filled up with an ink which was prepared based on ethanol as the main solvent and had a surface energy of about 23 mN/m at 25° C. with a density of about 0.86 g/cc.

While the free-ink type writing instrument thus obtained as example 1 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 1 on a polypropylene film was tested, good drawn lines were obtained without any drawn line being repellent. The drawn line drying property was also markedly good compared to water-based ink.

Example 2

Example 2 will be described next. A sectionally comb-shaped temporary ink collector formed of a polypropylene molding was disposed between a polypropylene ink tank chamber and a polyester writing tip. This sectionally comb-shaped temporary ink collector was constructed such that the farthest comb-toothed gap from the writing point was positioned at L1=3.5 cm away from the writing point, all the comb-toothed gaps located away by L2=2.7 cm or greater from the writing point were set at 0.15 mm, all the comb-toothed gaps located away by L2 to L3 (2.2 cm to shorter than 2.7 cm) from the writing point were set at 0.20 mm, and all the comb-toothed gaps located shorter than L3=2.2 cm away from the writing point were set at 0.25 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on n-propanol as the main solvent and had a surface energy of about 23.5 mN/m at 25° C. with a density of about 0.83 g/cc.

While the free-ink type writing instrument thus obtained as example 2 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 2 on a polypropylene film was tested, good drawn lines were obtained without any drawn line being repellent. The drawn line drying property was on the same level as water-based ink.

Example 3

Next, example 3 will be described. A sectionally comb-shaped temporary ink collector formed of a polypropylene molding was disposed between a polypropylene ink tank chamber and a polyester writing tip. With reference to FIG. 2, the sectionally combed configuration of the sectionally comb-shaped temporary ink collector used in example 3 will be described. This sectionally comb-shaped temporary ink collector was constructed such that the farthest comb-toothed gap from the writing point was positioned at L1=3.5 cm away from the writing point, all the comb-toothed gaps located away by L2=2.7 cm or greater from the writing point were set at 0.15 mm, all the comb-toothed gaps located away by L2 to L3 (2.2 cm to shorter than 2.7 cm) from the writing point were set at 0.20 mm, and all the comb-toothed gaps located shorter than L3=2.2 cm away from the writing point were set at 0.25 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on propylene glycol mono-methyl-ether as the main solvent and had a surface energy of about 25 mN/m at 25° C. with a density of about 0.945 g/cc.

While the free-ink type writing instrument thus obtained as example 3 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 3 on a polypropylene film was tested, good drawn lines were obtained without any drawn line being repellent. The drawn line drying property was on the same level as water-based ink.

Example 4

Next, example 4 will be described. A sectionally comb-shaped temporary ink collector formed of a polypropylene molding was disposed between a polypropylene ink tank chamber and a polyester writing tip. With reference to FIG. 2, the sectionally combed configuration of the sectionally comb-shaped temporary ink collector used in example 4 will be described. This sectionally comb-shaped temporary ink collector was constructed such that the farthest comb-toothed gap from the writing point was positioned at L1=4.0 cm away from the writing point, all the comb-toothed gaps located away by L2=3.5 cm or greater from the writing point were set at 0.13 mm, all the comb-toothed gaps located away by L2 to L3 (2.5 cm to shorter than 3.5 cm) from the writing point were set at 0.15 mm, all the comb-toothed gaps located away by L3 to L4 (2.0 cm to shorter than 2.5 cm) from the writing point were set at 0.20 mm, and all the comb-toothed gaps located shorter than L4=2.0 cm away from the writing point were set at 0.25 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on the main solvent made up of propylene glycol mono-methyl-ether and n-propanol blended in a ratio by weight of 7:3 and had a surface energy of about 25 mN/m at 25° C. with a density of about 0.945 g/cc.

While the free-ink type writing instrument thus obtained as example 4 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 4 on a polypropylene film was tested, good drawn lines were obtained without any drawn line being repellent. The drawn line drying property was on the same level as water-based ink.

Example 5

Next, example 5 will be described. A sectionally comb-shaped temporary ink collector formed of an ABS molding was disposed between a polypropylene ink tank chamber and a polyester writing tip. With reference to FIG. 2, the sectionally combed configuration of the sectionally comb-shaped temporary ink collector used in example 5 will be described. This sectionally comb-shaped temporary ink collector was constructed such that the farthest comb-toothed gap from the writing point was positioned at L1=4.0 cm away from the writing point, all the comb-toothed gaps located away by L2=3.5 cm or greater from the writing point were set at 0.13 mm, all the comb-toothed gaps located away by L2 to L3 (2.7 cm to shorter than 3.5 cm) from the writing point were set at 0.15 mm, all the comb-toothed gaps located away by L3 to L4 (2.2 cm to shorter than 2.7 cm) from the writing point were set at 0.20 mm, and all the comb-toothed gaps located shorter than L4=2.2 cm away from the writing point were set at 0.25 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on water as the main solvent and had a surface energy of about 29 mN/m at 25° C. with a density of about 1.1 g/cc.

While the free-ink type writing instrument thus obtained as example 5 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 5 on a polypropylene film was tested, good drawn lines were obtained without any drawn line being repellent.

Example 6

Next, example 6 will be described. A sectionally comb-shaped temporary ink collector formed of an ABS molding was disposed between a polypropylene ink tank chamber and a polyester writing tip. With reference to FIG. 2, the sectionally combed configuration of the sectionally comb-shaped temporary ink collector used in example 6 will be described. This sectionally comb-shaped temporary ink collector was constructed such that the farthest comb-toothed gap from the writing point was positioned at L1=3.5 cm away from the writing point, all the comb-toothed gaps located away by L2=3.0 cm or greater from the writing point were set at 0.13 mm, all the comb-toothed gaps located away by L2 to L3 (2.5 cm to shorter than 3.0 cm) from the writing point were set at 0.15 mm, all the comb-toothed gaps located away by L3 to L4 (2.0 cm to shorter than 2.5 cm) from the writing point were set at 0.20 mm, and all the comb-toothed gaps located shorter than L4=2.0 cm away from the writing point were set at 0.25 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on water as the main solvent and had a surface energy of about 26 mN/m at 25° C. with a density of about 1.08 g/cc.

While the free-ink type writing instrument thus obtained as example 6 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 6 on a polypropylene film was tested, good drawn lines were obtained without any drawn line being repellent.

Example 7

Next, example 7 will be described. A sectionally comb-shaped temporary ink collector formed of an ABS molding was disposed between a polypropylene ink tank chamber and a polyester writing tip. With reference to FIG. 2, the sectionally combed configuration of the sectionally comb-shaped temporary ink collector used in example 7 will be described. This sectionally comb-shaped temporary ink collector was constructed such that the farthest comb-toothed gap from the writing point was positioned at Ll=3.0 cm away from the writing point, all the comb-toothed gaps located by L2=2.5 cm or greater away from the writing point were set at 0.13 mm, and all the comb-toothed gaps located shorter than L2=2.5 cm away from the writing point were set at 0.17 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink typewriting instrument was filled up with an ink which was prepared based on water as the main solvent and had a surface energy of about 21 mN/m at 25° C. with a density of about 1.0 g/cc.

While the free-ink type writing instrument thus obtained as example 7 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 7 on a polypropylene film was tested, good drawn lines were obtained without any drawn line being repellent.

Example 8

Next, example 8 will be described. A sectionally comb-shaped temporary ink collector formed of polyethylene terephthalate vanes was disposed between a polypropylene ink tank chamber and a polyester writing tip. With reference to FIG. 2, the sectionally combed configuration of the sectionally comb-shaped temporary ink collector used in example 8 will be described. This sectionally comb-shaped temporary ink collector was constructed such that the farthest comb-toothed gap from the writing point was positioned at L1=5.0 cm away from the writing point, all the comb-toothed gaps located away by L2=4.0 cm or greater from the writing point were set at 0.10 mm, all the comb-toothed gaps located away by L2 to L3 (3.5 cm to shorter than 4.0 cm) from the writing point were set at 0.23 mm, all the comb-toothed gaps located away by L3 to L4 (2.5 cm to shorter than 3.5 cm) from the writing point were set at 0.15 mm, and all the comb-toothed gaps located shorter than L4=2.5 cm away from the writing point were set at 0.2 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on ethanol as the main solvent and had a surface energy of about 21 mN/m at 25° C. with a density of about 0.8 g/cc.

While the free-ink type writing instrument thus obtained as example 8 was put with its writing tip downwards, the surrounding pressure was gradually decreased until all the gaps between combed teeth in the temporary ink collector were filled up with ink.. During the process of having the all the gaps between combed teeth in the temporary ink collector filled up with ink, no ink leaked out from the writing tip, and the ink stored in the gaps between combed teeth remained continuously within the gaps without any leakage from the writing tip. Thereafter, when writing of the free-ink type writing instrument thus obtained as example 8 on a polypropylene film was tested, good drawn lines were obtained without any drawn line being repellent. The drawn line drying property was also markedly good compared to water-based ink.

Comparative Example 1

Next, comparative example 1 will be described. A sectionally comb-shaped temporary ink collector formed of polyethylene terephthalate vanes was disposed between a polypropylene ink tank chamber and a polyester writing tip. The sectionally combed configurations of the sectionally comb-shaped temporary ink collectors used in the comparative examples hereinbelow are the same as that shown in FIGS. 1 and 2, so the description will be omitted. This sectionally comb-shaped temporary ink collector was constructed such that the farthest comb-toothed gap from the writing point was positioned at L1=3.5 cm away from the writing point and all the comb-toothed gaps located from the writing point to L1=3.5 cm were set at 0.20 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on water as the main solvent and had a surface energy of about 40 mN/m at 25° C. with a density of about 1.08 g/cc.

While the free-ink type writing instrument thus obtained as comparative example 1 was put with its writing tip downwards, the surrounding pressure was gradually decreased until all the gaps between combed teeth in the temporary ink collector were filled up with ink. During the process of having the all the gaps between combed teeth in the temporary ink collector filled up with ink, no ink leaked out from the writing tip, and the ink stored in the gaps between combed teeth remained continuously within the gaps without any leakage from the writing tip. However, when writing of the thus obtained free-ink type writing instrument on a polypropylene film was tested, drawn lines were repelled so that acceptable drawn lines could not be obtained.

Comparative Example 2

Next, comparative example 2 will be described. A sectionally comb-shaped temporary ink collector formed of a polypropylene molding was disposed between a polypropylene ink tank chamber and a polyester writing tip. This sectionally comb-shaped temporary ink collector was constructed such that the farthest comb-toothed gap from the writing point was positioned at L1=3.5 cm away from the writing point and all the comb-toothed gaps located from the writing point to L1=3.5 cm were set at 0.20 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on polypropylene glycol mono-methyl-ether as the main solvent and had a surface energy of about 25 mN/m at 25° C. with a density of about 0.95 g/cc.

While the free-ink type writing instrument thus obtained as comparative example 2 was put with its writing tip downwards, the surrounding pressure was gradually decreased so that all the gaps between combed teeth in the temporary ink collector could be filled up with ink. However, before ink filled all the gaps between combed teeth in the temporary ink collector, an ink droplet arose at the writing point, and no ink could be held in the combed gaps 2.7 cm or greater away from the writing point.

Comparative Example 3

Next, comparative example 3 will be described. A sectionally comb-shaped temporary ink collector formed of a polypropylene molding was disposed between a polypropylene ink tank chamber and a polyester writing tip.

This sectionally comb-shaped temporary ink collector was constructed such that the farthest comb-toothed gap from the writing point was positioned at L1=3.5 cm away from the writing point and all the comb-toothed gaps located from the writing point to L1=3.5 cm were set at 0.20 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on n-propanol as the main solvent and had a surface energy of about 23 mN/m at 25° C. with a density of about 0.86 g/cc.

While the free-ink typewriting instrument thus obtained as comparative example 3 was put with its writing tip downwards, the surrounding pressure was gradually decreased so that all the gaps between combed teeth in the temporary ink collector were filled up with ink. During the process of having the all the gaps between combed teeth in the temporary ink collector filled up with ink, an ink droplet arose at the writing point, and ink held in the combed gaps 2.7 cm or greater away from the writing point could not stay therein and leaked out from the writing tip.

Comparative Example 4

Next, comparative example 4 will be described. A sectionally comb-shaped temporary ink collector formed of a polypropylene molding was disposed between a polypropylene ink tank chamber and a polyester writing tip.

This sectionally comb-shaped temporary ink collector was constructed such that the farthest comb-toothed gap from the writing point was positioned at L1=3.5 cm away from the writing point and all the comb-toothed gaps located from the writing point to L1=3.5 cm were set at 0.20 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on polypropylene glycol mono-methyl-ether as the main solvent and had a surface energy of about 23 mN/m at 25° C. with a density of about 0.86 g/cc.

While the free-ink type writing instrument thus obtained as comparative example 4 was put with its writing tip downwards, the surrounding pressure was gradually decreased so that all the gaps between combed teeth in the temporary ink collector were filled up with ink. During the process of having the all the gaps between combed teeth in the temporary ink collector filled up with ink, an ink droplet arose at the writing point, and ink held between the combed gaps 2.7 cm or greater away from the writing point could not stay therein and leaked out from the writing tip.

Comparative Example 5

Next, comparative example 5 will be described. A sectionally comb-shaped temporary ink collector formed of an ABS molding was disposed between a polypropylene ink tank chamber and a polyester writing tip.

This sectionally comb-shaped temporary ink collector was constructed such that the farthest comb-toothed gap from the writing point was positioned at L1=3.5 cm away from the writing point and all the comb-toothed gaps located from the writing point to L1=3.5 cm were set at 0.20 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on water as the main solvent and had a surface energy of about 26 mN/m at 25° C. with a density of about 1.1 g/cc.

While the free-ink type writing instrument thus obtained as comparative example 5 was put with its writing tip downwards, the surrounding pressure was gradually decreased so that all the gaps between combed teeth in the temporary ink collector were filled up with ink. During the process of having the all the gaps between combed teeth in the temporary ink collector filled up with ink, an ink droplet arose at the writing point, and ink held in the combed gaps 2.4 cm or greater away from the writing point could not stay therein and leaked out from the writing tip.

Comparative Example 6

Next, comparative example 6 will be described. A sectionally comb-shaped temporary ink collector formed of a polypropylene molding was disposed between a polypropylene ink tank chamber and a polyester writing tip.

This sectionally comb-shaped temporary ink collector was constructed such that the farthest comb-toothed gap from the writing point was positioned at L1=0.9 cm away from the writing point and all the comb-toothed gaps located from the writing point to L1=0.9 cm were set at 0.20 mm. The temporary ink collector and the ink tank chamber were separated by a partitioning wall having an air replacement hole of a channel narrower than any of the comb-toothed gaps in the sectionally comb-shaped temporary ink collector while the pen core was arranged so as to penetrate through the temporary ink collector into the ink tank chamber. The ink tank of the thus constructed free-ink type writing instrument was filled up with an ink which was prepared based on ethanol as the main solvent and had a surface energy of about 23 mN/m at 25° C. with a density of about 0.86 g/cc.

While the free-ink type writing instrument thus obtained as comparative example 6 was put with its writing tip downwards, the surrounding pressure was gradually decreased so that all the gaps between combed teeth in the temporary ink collector could be filled up with ink. During the process of having the all the gaps between combed teeth in the temporary ink collector filled up with ink, no ink leaked out from the writing tip. However, only slight reduction in surrounding pressure caused ink to fill all the gaps between combed teeth, so that this configuration could not provide the function of a temporary ink collector at all.

According to the present invention described heretofore, a free-ink type writing instrument uses an ink having a surface tension of lower than 30 mN/m charged in the ink tank, in combination with a sectionally comb-shaped temporary ink collector in which all or part of the gaps between combed teeth are set equal to 0.15 mm or smaller. This configuration makes it possible for the free-ink type writing instrument to retain the ink, which will be pushed out from the ink tank when volume expansion in the empty space inside the ink tank occurs due to ambient change, within the temporary ink collector without any leakage of ink from the writing tip, as well as to use an ink which can be distributed on a writing surface of a lower surface energy without any drawn line repellence and is excellent in drawn line drying property.

What is claimed is:

1. A free-ink type writing instrument comprising:

an ink tank chamber;

a writing tip;

a temporary ink collector having a sectionally combed configuration, disposed between the ink tank chamber and the writing tip;

a partitioning wall having an air replacement hole therein, disposed for separating the ink tank chamber and the temporary ink collector; and an ink feed or pen core arranged so as to penetrate through the temporary ink collector and projected into, or penetrated up to, the ink tank chamber, characterized in that the sectionally comb-shaped temporary ink collector is disposed 2.0 cm or greater away from the writing tip, all or part of the gaps between neighboring combed teeth for retaining ink in the temporary ink collector are set equal to 0.15 mm or smaller, and the ink tank chamber is charged with an ink having a surface tension equal to 30 mN/m or lower at 25° C.

* * * * *